US005956875A

United States Patent [19]

Aughenbaugh

[11] Patent Number: 5,956,875

[45] Date of Patent: Sep. 28, 1999

[54] POST SLEEVE

[76] Inventor: Timonthy A. Aughenbaugh, R.R. 1, Iroquois, S. Dak. 57353

[21] Appl. No.: 08/920,226

[22] Filed: Aug. 25, 1997

[51] Int. Cl.[6] ..... G09F 15/00

[52] U.S. Cl. ..... 40/607; 256/48; 40/612

[58] Field of Search ..... 40/606, 607, 612; 256/32, 48, 50, 19, DIG. 5

[56] References Cited

U.S. PATENT DOCUMENTS

| | | | |
|---|---|---|---|
| 1,621,810 | 3/1927 | Rice | 40/660 |
| 1,676,927 | 7/1928 | Richard | 40/660 |
| 1,900,945 | 3/1933 | Myers, Jr. | 40/607 X |
| 2,074,280 | 3/1937 | Smith | 40/612 |
| 2,186,428 | 1/1940 | Patten | 40/660 X |
| 2,660,822 | 12/1953 | Hargus | 40/606 |
| 3,131,792 | 5/1964 | Groneman et al. | 52/38 |
| 3,267,805 | 8/1966 | Ackerman | 40/607 X |
| 3,355,998 | 12/1967 | Roemisch . | |
| 3,729,847 | 5/1973 | Chandos | 40/604 |
| 4,250,647 | 2/1981 | Woodard | 40/607 X |
| 4,454,671 | 6/1984 | Morgenstern | 40/607 |
| 4,516,756 | 5/1985 | Beatty | 256/1 |
| 4,520,231 | 5/1985 | Hubbell | 256/48 X |
| 4,680,428 | 7/1987 | Wilson, Jr. | 256/48 X |
| 4,864,757 | 9/1989 | Lovett | 40/607 |
| 5,044,200 | 9/1991 | Dailey et al. | 40/607 X |
| 5,085,409 | 2/1992 | Teixeira | 256/48 |
| 5,299,883 | 4/1994 | Arth, Jr. | 52/301 X |
| 5,323,583 | 6/1994 | Venegas, Jr. | 52/301 X |
| 5,560,093 | 10/1996 | Hutton et al. | 40/607 X |
| 5,560,131 | 10/1996 | Gibson | 40/607 |
| 5,606,815 | 3/1997 | Feldwhere | 40/607 |
| 5,755,431 | 5/1998 | Williams | 256/19 |

*Primary Examiner*—Joanne Silbermann
*Attorney, Agent, or Firm*—Craig J. Lervick

[57] ABSTRACT

A post sleeve having a tube-like structure comprising an interior and an exterior surface is provided which provides superior capabilities for use as an indicator or marking sign. The interior comprises a channel for slidingly engaging a post having a T-shaped or U-shaped cross section such that internal dimensions of the channel precludes rotation of the sleeve about a longitudinal axis of the post. The exterior surface having an appropriate area which can easily receive labels or marking indicators.

18 Claims, 9 Drawing Sheets

POST SLEEVE

BACKGROUND OF THE INVENTION

The present invention is a device for use in identifying locations and providing a means for validating information. More specifically, the present invention relates to a tubular sleeve, that slidably attaches over a traditional fence post or sign post that is secured in the ground, the internal dimensions of the sleeve being substantially congruent enough with the external dimensions of the fence post or sign post such that rotation of the sleeve about a longitudinal axis of a post is precluded, the sleeve having at least means for validating the location of the sleeve and identifying and measuring data at the sleeve location.

Installation of signs, identification markers and apparatus for supporting validation and identification equipment can be difficult, time consuming and ineffective. Traditionally, when a need for a sign on a post arises, an individual selects a metal sign post, the sign post traditionally having a stretched U-shaped configuration, and either sets the sign post in a predug hole or drives the sign post into the ground, subsequently attaching a sign to the sign post. Sign posts are traditionally metal, but can be comprised of materials such as plastic or fiberglass. Sign posts set in the ground in a hole for such are usually considered permanent sign posts. Digging a hole to insert a permanent sign post takes considerable time and effort and is many times not practical. Furthermore, after installation of the permanent sign post, the volume of the hole remaining around the permanent sign post must be back filled either with the dirt dug out of the hole or with a securing material such as concrete. The conventional method of digging holes for sign posts in order to erect a sign, although practical for large permanent signs, is not practical where time, cost, space and flexibility are of the essence. In addition, changing the means for displaying information, i.e., the sign on the permanent sign post, usually requires the disassembly of a fastening means such as nuts and bolts, screws or nails. Changing just one sign can be very time consuming not to mention when a large amount of signs must be changed. Furthermore, replacement of permanent sign posts set in the ground can be costly and time consuming. When a permanent sign post is knocked down or needs to be adjusted, the process of replacing and/or adjusting usually requires the removal of the existing sign post by redigging the hole or removing the securing material and then replacing the sign post with a new post and refilling the hole.

A conventional method for erecting more temporary sign posts is through the driving into the ground of sign posts. The narrow cross-sectional configurations of these sign posts allow the posts to be easily inserted into the ground. After the sign post is driven into the ground, a sign is secured to the sign post. The sign posts, although economical, are not usually considered aesthetically pleasing.

Although not traditionally used, metal fence posts having a T-shaped cross section could also be used for erecting signs. Throughout the remainder, fence posts and sign posts will be referred to collectively as "posts."

Installation of the temporary sign post by driving it into the ground is more economical than the permanent sign post. The installation of a sign on the temporary sign post, however, is beset with the same costs and inefficiencies as a permanent sign post. The installation of the temporary sign post usually involves the securing of the sign by screws, nuts and bolts, or wire. This method of securing the sign precludes easy removal of the sign from the sign post. This is not very convenient where a sign must be changed regularly.

The signs attached to the posts usually comprise a flat metal. The signs are not very aerodynamic and get blown down or easily twisted in a stiff wind. In addition, because of the sign's flat two-dimensional configuration, the application of information to the sign is limited to no more than two sides of the sign. In order to display information in more than two directions, a second sign must be attached to the post perpendicular to the first sign. This configuration, however, further decreases the aerodynamic stability of the sign post, thereby increasing the likelihood that the sign will be blown down or damaged by the wind.

Conventional methods of designating an intersection or a crossroad are not effective in areas where strong winds exist. The signs constantly get blown down. In addition, a majority of the sign posts used for signs are permanent sign posts. The placement and replacement cost, in both time and money, of conventional permanent sign posts used at an intersection or crossroads is quite high. To avoid these costs, rural governments avoid installing intersection and crossroads signs or limit the installation of permanent sign posts to busier intersections. This practice results in numerous intersections and crossroads existing without any signage to indicate the names of the intersecting roads. While the absence of the signage may not pose a problem to local residents, the lack of signage can readily create harm and/or inconvenience to nonresidents who cannot determine the names of the roads and to the residents if a rescue worker or police vehicle cannot locate the residence being called to perform emergency work because no signs have been installed.

Similarly, conventional signage used in the agricultural industry also fails to be effective and cost efficient. Due to the agronomic complexity of pesticides, herbicides and fertilizers and cost of the associated application equipment, more and more producers of crops are turning to custom applicators to apply the pesticides, herbicides and fertilizers to their fields. Because applicators are not the people who plant the crop, they must be informed by the producer of the crop regarding the specific crop types and location of the field where specific crops are growing. Crop identification and location, as explained more fully below, has long been a significant issue to producers and pesticide, herbicide and fertilizer dealers and their respective applicators.

Without knowledge of the location of a field, an applicator can accidentally deliver product to the wrong field or even the wrong farm. Such an accident can have catastrophic effects, causing both the affected and unaffected crop to die or not properly mature.

In addition, improper identification of crop type can also lead to catastrophic effects. For example, certain varieties of soybean crops exist and are being further developed that are herbicide tolerant. The different soybean varieties, however, cannot necessarily be distinguished visually by the naked eye. An applicator, therefore, can approach a crop of soybeans with a sprayer full of herbicide and have no way of knowing by looking at the crop whether the soybean crop is herbicide tolerant or not. Application of the herbicide to a non-herbicide tolerant soybean crop would kill the crop. An applicator, thus, must take the time to seek out the producer to determine the crop type. Conveying proper location information and crop identification to the sprayer operators is obviously a critical job.

Value added traits in genetics have location and identification obstacles as well. Producers currently have to keep track of only a handful of crop types. As more specific traits are developed within crop types, producers will have to plant, specifically treat, harvest, store and deliver various assortments of crop types. Beyond being able to deliver the proper grain to the proper processor, very accurate field histories of previous crops and herbicide applications will have to be maintained for proper field selection. No uniform system or device currently exists to deal with these problems.

One conventional way of validating field location is through the installation of a flag in the ground. Specifically, a certain color or type of flag is placed near the field to validate the location of the field. This method of validating a field, however, is not very effective for an applicator because it is usually specific only to a certain farm. Thus, in order for an applicator to know the specific location of certain crops on different farms, the applicator must learn what each flag represents on each farm. This task can become daunting and prone to error when the applicator is servicing a large number of farms and numerous different flags are used to denote field locations or, even more so, when identical flags are used for different crops on different farms. Furthermore, the use of flags as sole designators of field locations is not universal. A producer may use flags to designate location of a field, location of underground power lines, water lines or other features besides field location. An applicator has no consistent universal location on each farm for determining field location.

In addition to being an ineffective means for validating crop location, the conventional method of using flags is also an ineffective means for validating the identity of crop types. There are hundreds to thousands of various types of different crops. Within each crop type there can be hundreds of different varieties. Moreover, each year, more and more different varieties of crop types are introduced. Each variety can require different types or combinations of pesticides, fertilizers or herbicides. Using the conventional flag system to identify crop types, therefore, is not practical because a different flag color or type would have to be used for each crop variety in order to ensure that an applicator knew exactly what crop variety was in the field in order to apply the proper pesticide, fertilizer and/or herbicide. As more flags are used, the likelihood of an error occurring increases because the applicator will have to distinguish between flags that are more similar in color. For example, the difference between burnt orange and rust orange.

Flags are also ineffective because they constantly get blown away, knocked down or damaged by such things as inclement weather or farm equipment. Flags are also not cost effective because they usually are not durable enough to last for more than a few seasons and, thus, must be replaced often. Decreasing this cost effectiveness further is the fact that the flags must be replaced when a new type of crop or crop variety is introduced in the field.

Finally, the conventional method of using a flag to validate a field is also very time consuming. An applicator must meet with each producer prior to applying any product in order to determine what location and identification each flag represents on the farm.

Another conventional method to validate field location and/or identify crop type is to use colored rags on fences. This method is similar to the flag method and suffers from many of the same inadequacies. There is no uniform system for utilizing rags to designate crop location and crop type. An applicator is required to inquire upon each producer as to the meaning of each color. Rags can easily be removed, blown away or fade from inclement weather or misuse. Rags also wear out and need to be replaced quite often The use of rags, like the use of flags, requires a producer to use a myriad of colors to designate the numerous types and varieties of crops. Similar to the use of flags, the conventional method of using rags to validate crop location and identify crop type is error prone, time consuming and ineffective.

Other conventional methods used to validate crop location and crop type include cardboard and wooden signs. These methods are also inadequate means for validating field location and crop type. No uniform system utilizing wooden or cardboard signs exists for validating crop location and crop type. An applicator must inquire upon each producer as to the meaning behind each color, shape, number or word utilized with a cardboard or wooden sign in order to validate crop location or crop type. Cardboard signs get ruined or blown away and wear out quickly. Wooden signs rot and need to be repainted every time a new crop or crop variety is introduced.

The conventional methods of validating field location and crop type, set forth above, are not desirable. As mentioned, no universal system for utilizing the conventional methods exists. In addition, the conventional methods are not practical because they get blown away, removed, knocked down or destroyed easily. They also do not provide an efficient or effective means for updating information regarding field location or crop type. Furthermore, modification to the conventional methods, for purposes of adding additional means for measuring or validating data, is not possible and/or practical. The conventional methods also do not provide a practical means for downloading information regarding field location, crop type, herbicides, pesticides or fertilizers used or other historical data.

SUMMARY OF THE INVENTION

The present invention is a sleeve suitable for validating a desired location and identifying an associated product, structure or object. The present invention is a tube-like structure having an interior, longitudinally disposed channel, the channel having at least a portion of its internal dimensions substantially congruent with the external dimensions of a post such as a traditional fence post having a T-shaped or sign post having a U-shaped cross section. In operation, the lower portion of the post is secured in the ground and the sleeve is slidably attached over at least a portion of the post extending from the ground. The interior dimensions of the channel substantially congruent with the external dimensions of the post precluding rotational movement of the sleeve about a longitudinal axis of the post when the sleeve slidably engages the post. At least one locking mechanism, positioned on the sleeve, providing means for releasably engaging the sleeve to the post in order to prevent longitudinal movement of the sleeve with respect to the longitudinal axis of the post.

The present invention is an improvement over the conventional method of digging holes to install a permanent sign post because of its ability to be quickly set into the ground in virtually any location, to withstand the forces of inclement weather because of its aerodynamic shape, to provide an economical but highly effective means for marking or designating a location, and to provide a means for releasably attaching additional signs or modular add-ons or extensions. For example, the present invention, in a first embodiment, is a rectangular tube having an interior channel, the channel having at least a portion of its internal dimensions substantially congruent with the external dimensions of a metal fence post. In operation, the lower portion of the fence post is secured in the ground and the first embodiment is slidably attached over the metal fence post, the portions of the internal dimensions of the channel substantially congruent with the external dimensions of the metal fence post precluding rotational movement of the sleeve about a longitudinal axis in the metal fence post. The rectangular sleeve having four external sides, each side providing a means for displaying information regarding the names of streets at an intersection adjacent the metal fence post. In the first embodiment, the present invention is an improvement over the conventional method because the present invention can be quickly set up in rural areas without much cost, one piece of material is used to display information in four directions, and will be less likely to succumb to the forces of inclement weather because of its external configuration.

The present invention, in a second embodiment, is an improvement over the conventional methods of using a flag or a rag because of its ability to provide a universal means for validating crop location and crop type, allow for easy change or designation of crop location and crop type, withstand being blown away or damaged, and provide means for a producer to record or store data at the field location.

The second embodiment of the present invention provides a universal means for validating field location by providing a surface for receiving labels imprinted with a code representing the field location. The code could be developed by the producer or could conform to a field location designation system congruent with local practice or with a practice promoted by companies with which the producer conducts business. To designate field location, the sleeve and metal fence post, creating a validation system assembly, would be placed along the boundaries of a specific field. Each validation system assembly located along the specific field would have a label that verified the field location. Each code would represent a single field location or crop location, thus, whenever an applicator needed to know the location of a field or crop on a farm, the applicator would only need to locate the validation system assembly possessing the specific field location label. The field location label would be located in the same position on each sleeve in order to prevent accidental reading of the wrong information. Thus, an applicator would always look in the same place on the sleeve for field location. Preferably, the field location label would be secured to a label surface longitudinally disposed along the sleeve.

In the same manner, a second label would be applied to the sleeve to designate crop type. This label would also be placed in the same position on every sleeve, preferably directly below the field location label on the label surface. By reading the crop type label on the sleeve, an applicator can validate the identity of the crop in the field. Unlike the flag or rag system, one code would represent the same crop variety on each form. Preferably, each code label would be of the same type, color and size and always be placed in the same location on each sleeve regardless of crop variety.

Because the sleeve must be large enough to fit over a metal fence post, the size of the validation system assembly is an improvement over the conventional method of using a flag or a rag for purposes of field location validation because an applicator can readily see the location and/or boundaries of the field as designated by the validation system assemblies.

The present invention is also an improvement over the use of a flag because the present invention is not as likely as a flag to be blown away or knocked down. In operation, the present invention securely and slidably attaches over at least a portion of a metal fence post that is secured in the ground. The metal fence post, ordinarily made of steel and much heavier than a standard flag stick, will not easily be blown over or knocked over. Because the present invention, in operation, is slidably attached to the metal fence post, it too will not be blown over or knocked down easily like a flag. In addition, the present invention can be comprised of a white polyvinyl chloride material that is readily visible to the naked eye. A producer, therefore, is more likely to see the present invention than a small flag, lessening the likelihood of a producer knocking over the field validation system assembly with farm equipment, as compared to a less visible flag on a stick.

The present invention is also an improvement over the conventional method of using a flag or rag to designate the pesticide, herbicide or fertilizer to be used on the crop because the present invention provides a means for applying a universal system of cards, codes or labels that designate the proper pesticide, herbicide or fertilizer to be used on the crop. As mentioned above, the conventional method of using a flag or a rag requires a producer to use a myriad of different types and/or colors of flags or rags to designate field location, crop type, and applicable pesticide, herbicide and/or fertilizer to be applied to the crop. With the present invention, in operation, the producer only has to install the metal fence post then slide the sleeve over at least a portion of the metal fence post, attach a label designating field location, attach another label designating crop type, and then another label designating the proper pesticide, herbicide or fertilizer to be applied to the crop. The applicator, in a preferred embodiment of the present invention, no longer has to meet with the producer to determine field location, the crop type or applicable pesticide, herbicide or fertilizer.

The present invention is also an improvement over the conventional method of using a cardboard or wooden sign to validate field location and crop type. As stated above, with the conventional method of using a cardboard or wooden sign to validate crop location or crop type, an applicator must inquire upon each producer as to the meaning behind each color, shape, number or word utilized with a cardboard or wooden sign in order to validate crop location, crop type or applicable pesticide, herbicide or fertilizer. The present invention, however, does not require an applicator to inquire upon each producer as to field location, crop type or applicable pesticide, herbicide or fertilizer. The present invention has a universal means for designating the crop type and applicable pesticide, herbicide or fertilizer. Each farm, utilizing the present invention, can have the same code labels on the field validation system assembly as another farm possessing the same crop characteristics. In addition, because of its shape in the preferred embodiment, the present invention is an improvement over the wooden or cardboard sign because the trapezoidal aerodynamic shape of the preferred embodiment directs airflow around the present invention, greatly reducing the surface area available for wind to exert force on and force the validation system down. This is contrary to a wooden or cardboard sign that is not aerodynamic and can easily be knocked down by wind.

The present invention is also an improvement over the conventional methods set forth above because the top of the present invention can serve as a receptacle for modular add-on devices. Such add-on devices, for example, include extensions to the sleeve, rain gauges, radio antennas and electronic data storage devices. The electronic data storage devices, for example, provide a means for the tracking of value added crops. Such information can be readily transferred via electronics without the need for paperwork. The conventional methods provide no means for attaching additional validation equipment, nor do they provide means for storing such validation information.

While the present invention has been described as a sleeve, slidably attached to a post having a T-shaped or U-shaped cross section, other variations and modifications may be made to the invention described herein without deviating from the scope and spirit of the invention. For example, while the interior of the present invention comprises a channel having at least a portion of its internal dimensions substantially congruent with the external dimensions of a standard T-shaped or U-shaped metal post, numerous variations and modifications may be made to the exterior of the sleeve without deviating from the scope and spirit of the invention. In addition, it is understood that the internal dimensions of the channel can be modified to allow for the present invention to releasably, slidably engage a variety of metal posts having similar narrow, non-geometric cross sections. Moreover, it is understood that modifications such as utilizing the sleeve to validate quantities or types of cattle or as a means for installing temporary structures such as sleeves configured like bollards wherein rotational movement of the sleeve about the longitudinal axis of a metal fence post are to be considered within the scope and spirit of the invention.

BRIEF DESCRIPTION OF THE DRAWINGS

The above-mentioned objects and advantages can be more clearly seen by referring to the following detailed description and the drawings in which.

DETAILED DESCRIPTION OF THE INVENTION

Figure 1:
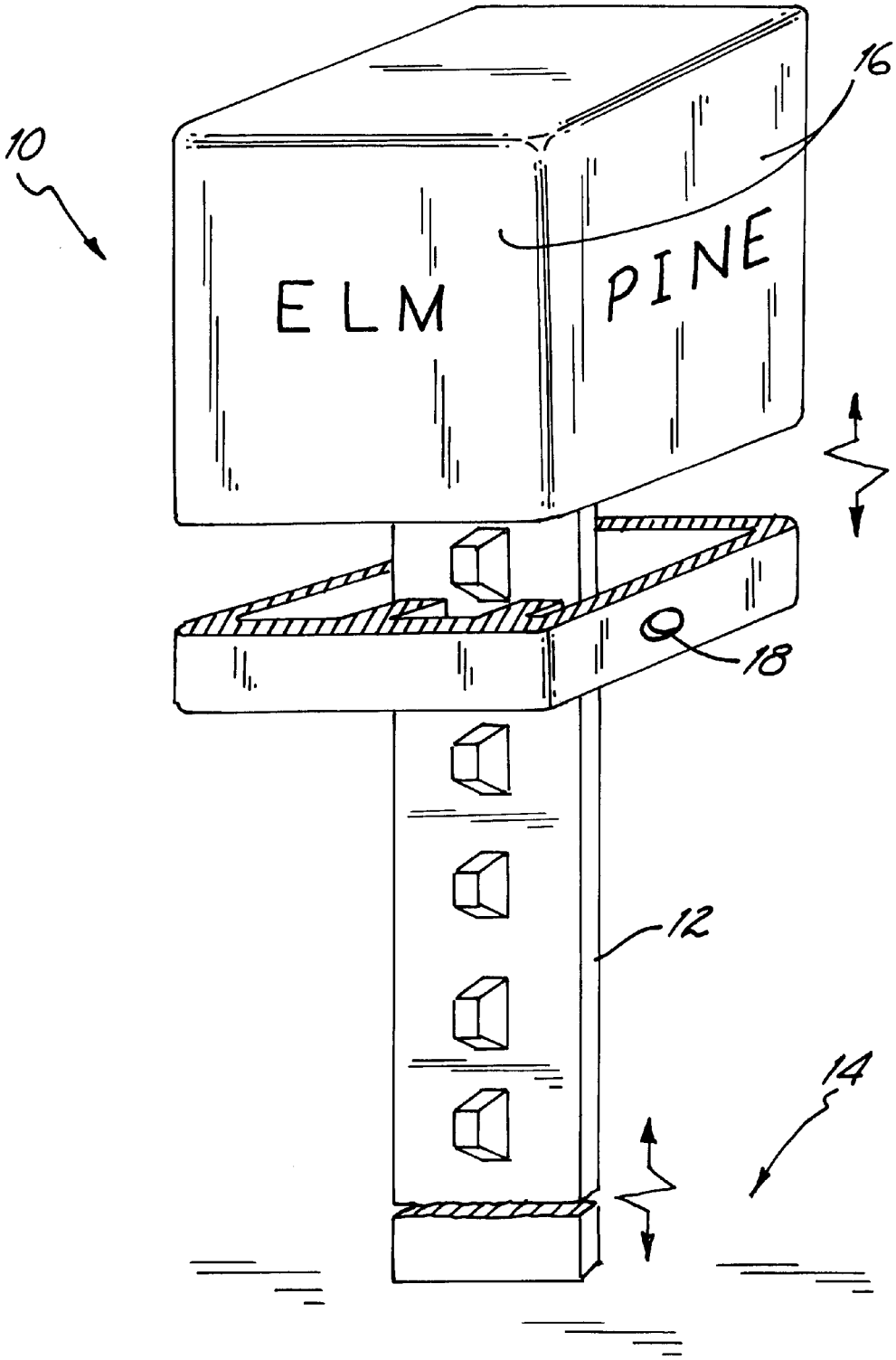
FIG. 1 is a front elevational view of a first embodiment of the present invention slidingly engaging a metal fence post having a T-shaped cross section.

Referring now to FIG. 1 which shows a front elevational view of a first embodiment of the present invention. For convenience, like numbers have been used to identify like parts.

FIG. 1 depicts a first embodiment of the present invention shown generally throughout as a sleeve 10. In operation, sleeve 10 slidingly engages at least a portion of a fence post 12 having a T-shaped cross section and secured in a ground 14. At least one label surface 16 is positioned on sleeve 10. Names of local objects such as streets may be provided on one or more label surfaces 16. A locking hole 18 is shown. Locking hole 18 provides access for a locking means to secure sleeve 10 to fence post 12.

Figure 2:
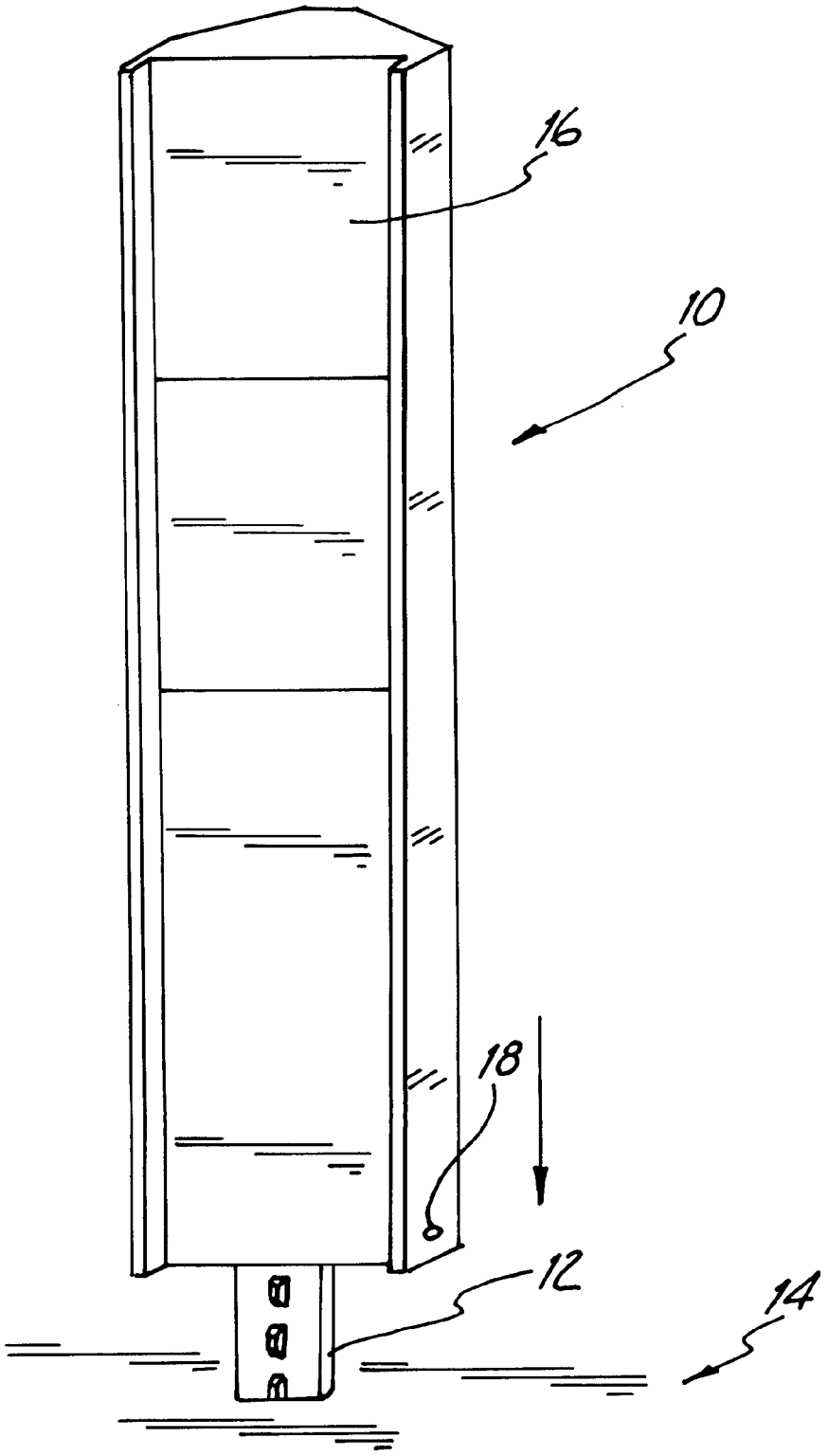
FIG. 2 is a front elevational view of a second embodiment of the present invention slidingly engaging a metal fence post having a T-shaped cross section.

FIG. 2 depicts a second embodiment of the present invention generally comprising sleeve 10 slidingly engaging fence post 12 secured in ground 14. Also shown is label surface 16 and locking hole 18.

Figure 3:
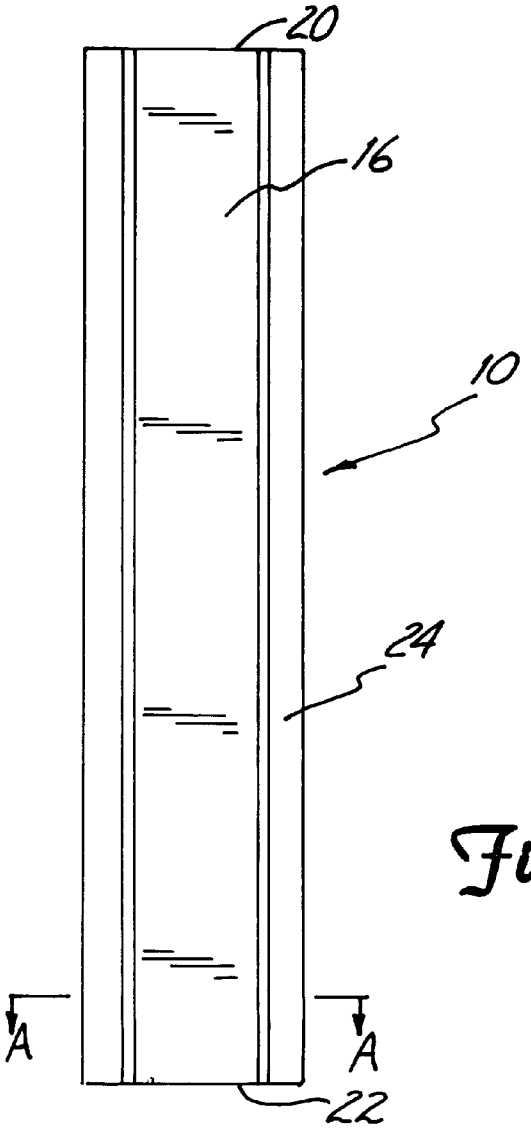
FIG. 3 is a front view of the second embodiment.

FIG. 3 depicts a front view of sleeve 10. More specifically, FIG. 3 depicts a top 20 and a bottom 22 of sleeve 10. In addition, label surface 16 is shown disposed longitudinally along a front face 24 of sleeve 10.

Figure 4:
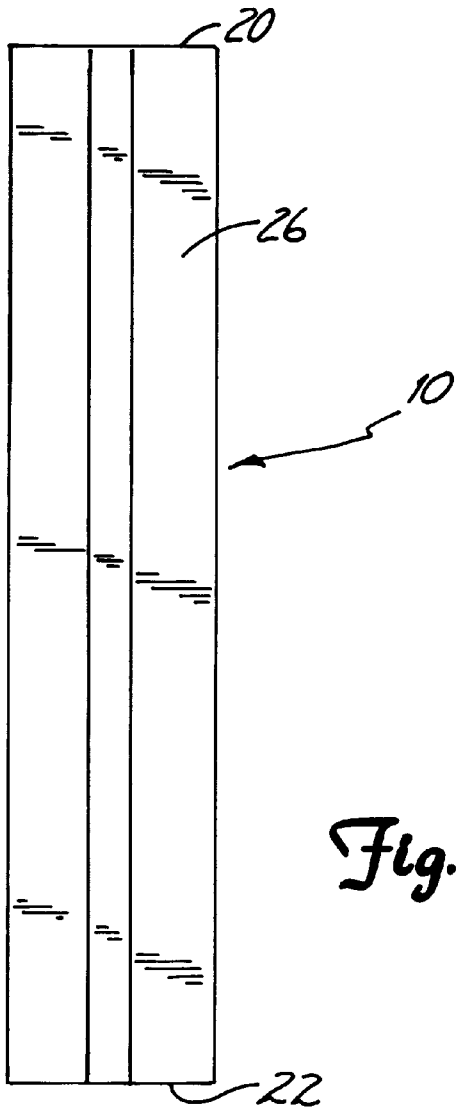
FIG. 4 is a rear view of the second embodiment.

FIG. 4 depicts a rear view of sleeve 10 having a rear face 26.

Figure 5A:
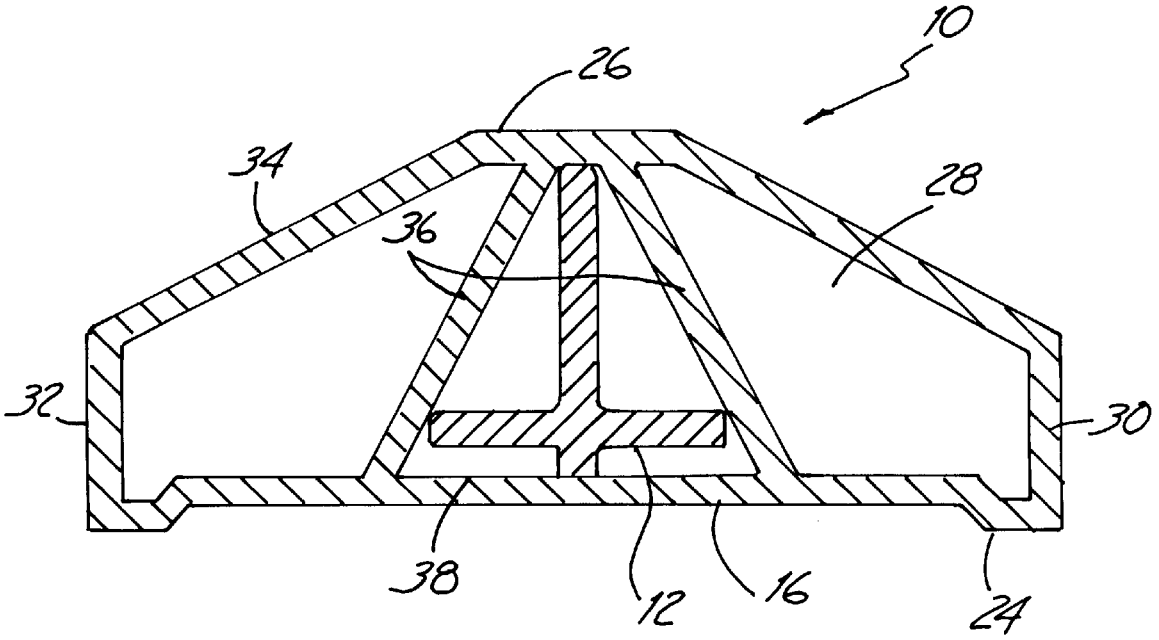
FIG. 5*a* is a cross sectional view of one embodiment of a channel in the second embodiment.
Figure 5B:
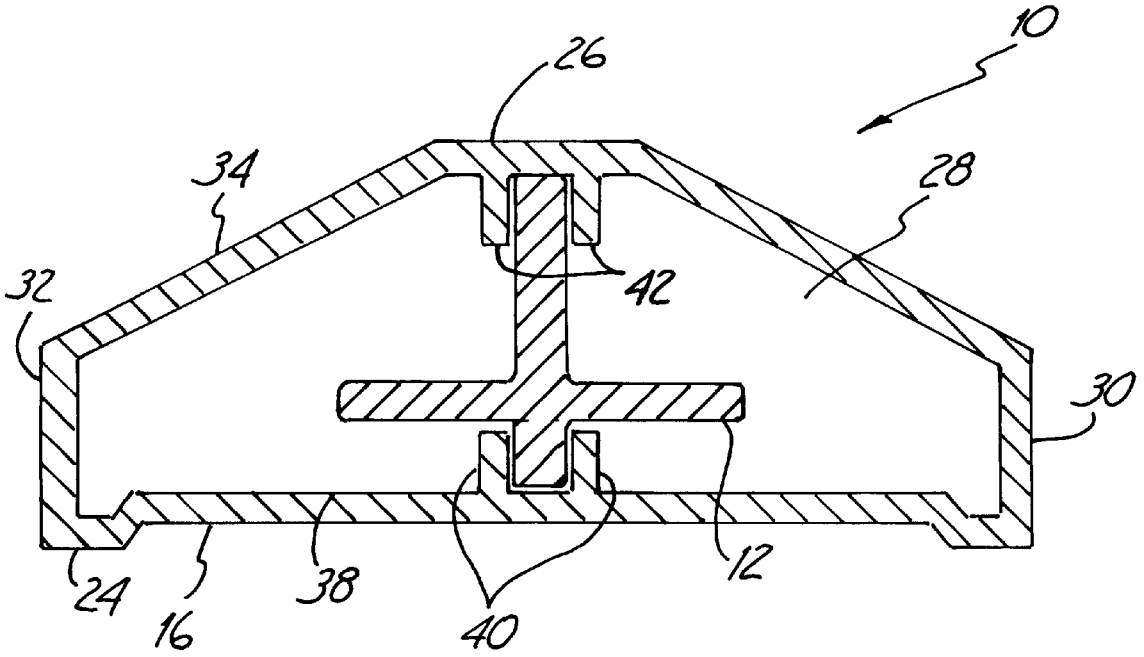
FIG. 5*b* is a cross sectional view of a second embodiment of the channel in the second embodiment.

FIGS. 5*a* and 5*b* depict cross sectional views of a first and a second embodiment of a channel 28 longitudinally disposed in sleeve 10. Fence post 12 is shown longitudinally disposed in channel 28 respectively. More specifically, FIG. 5*a* depicts a cross sectional view of sleeve 10 having front face 24, label surface 16, rear face 26, a first side 30, a second side 32, an exterior surface 34, and a webbing 36 forming internal dimensions of channel 28. Webbing 36 is configured such that, when metal fence post 12 slidingly engages through channel 28, contact between fence post 12 and webbing 36 and an interior channel wall 38 precludes rotational movement of sleeve 10 about the longitudinal axis of fence post 12.

FIG. 5*b* depicts a cross sectional view of sleeve 10 having front face 24, label surface 16, rear face 26, channel 28, first side 30, second side 32, exterior surface 34, interior channel wall 38, a plurality of front teeth 40, and a plurality of rear teeth 42. The teeth of front teeth 40 and rear teeth 42, respectively, are spaced such that the internal dimensions between each set of front teeth and each set of rear teeth are substantially congruent with the external dimensions of fence post 12. Furthermore, front teeth 40 and rear teeth 42 are opposingly positioned along and project from interior channel wall 38 in such a manner that when fence post 12 slidingly engages along front teeth 40 and rear teeth 42, rotational movement of sleeve 10 about the longitudinal axis of fence post 12 is precluded.

Figure 6:
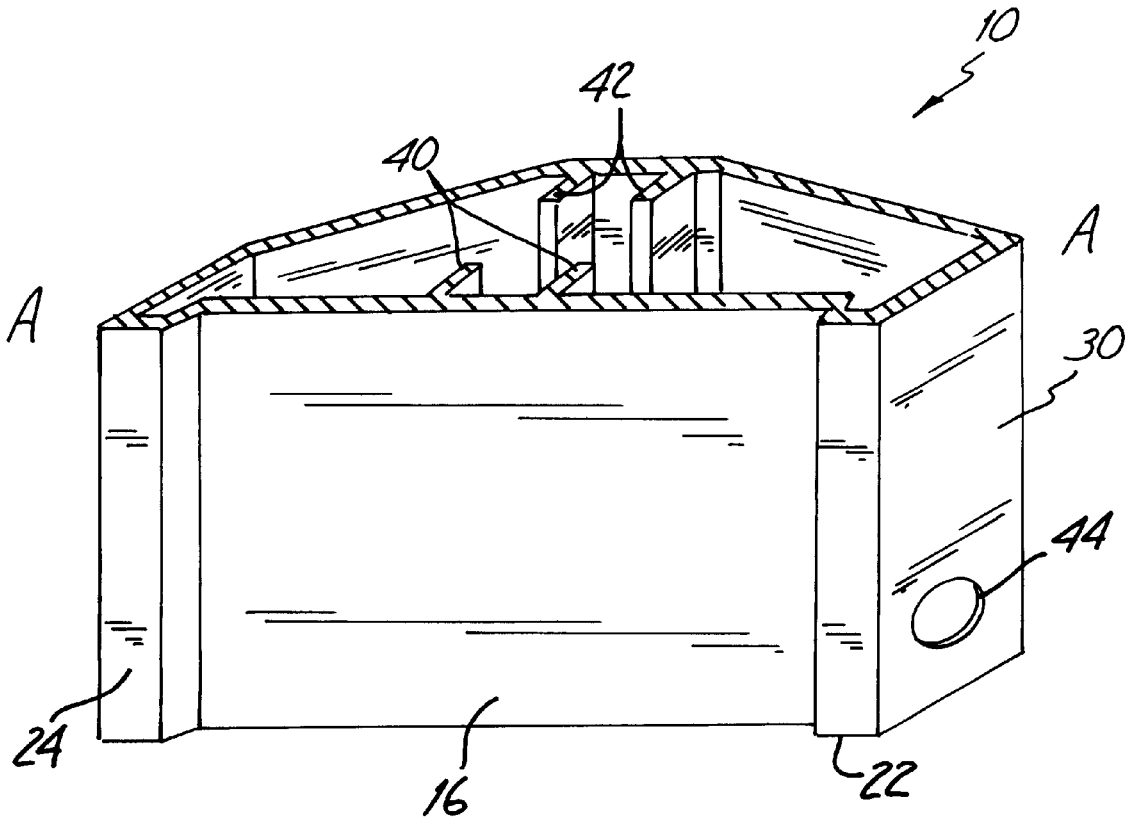
FIG. 6 is a front elevational view, with cross section, of the second embodiment with locking hole.

FIG. 6 depicts a cross-sectional, front elevational view of the second embodiment of sleeve 10, including at least one locking hole 44 positioned adjacent bottom 22 and first side 30. Locking hole 44 provides access for a bolt or wire tie or other fastening means to secure sleeve 10 to fence post 12.

Figure 7:
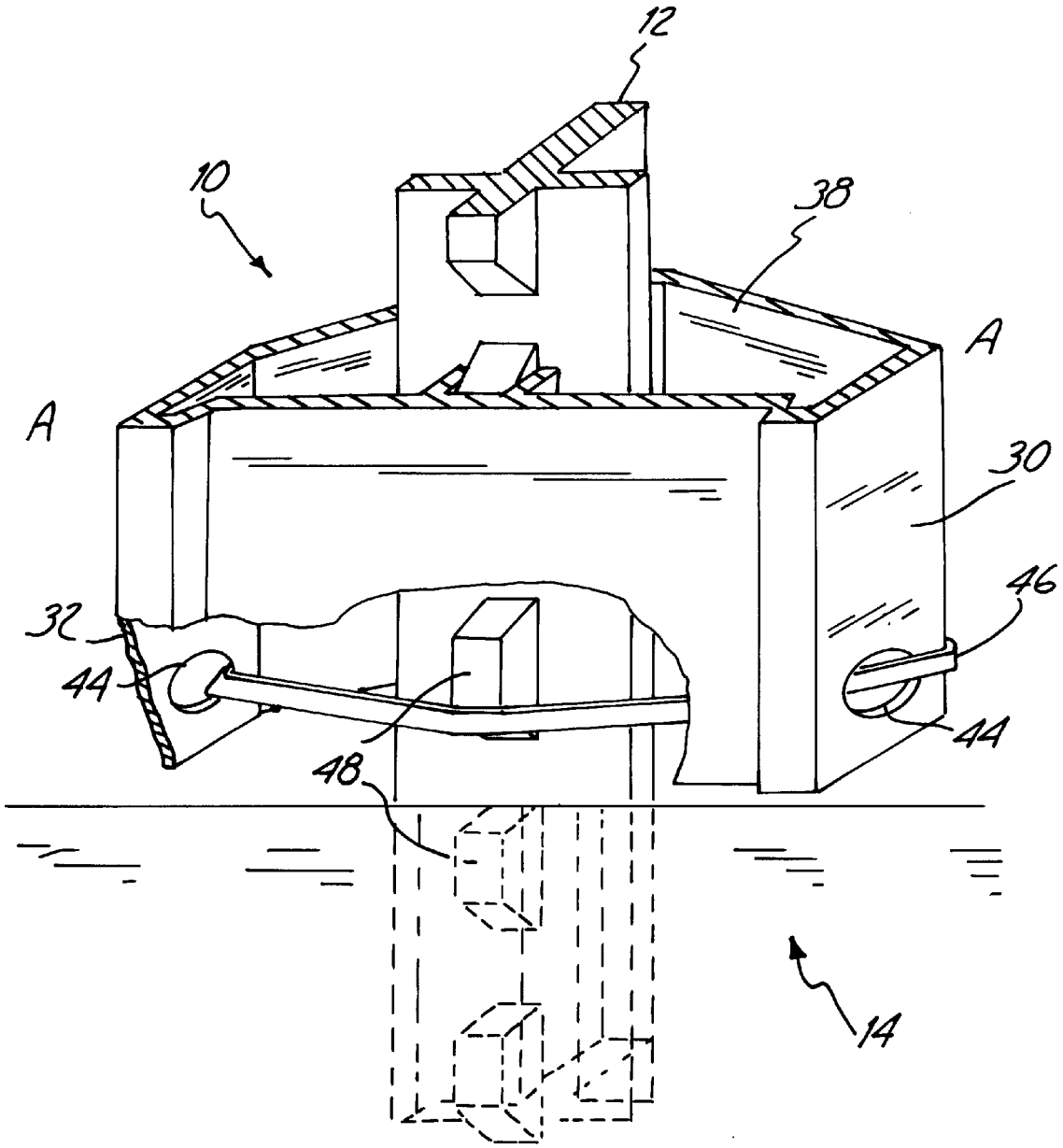
FIG. 7 is a front elevational view, with cross section, of the second embodiment of the present invention engaging a metal fence post having a T-shaped cross section with the portion of the metal fence post located in the ground shown in phantom.

FIG. 7 depicts a cross-sectional, front elevational view of the second embodiment of sleeve 10 with fence post 12 longitudinally disposed in channel 28. The portion of fence post 12 that is secured in ground 14 is drawn in phantom. In operation, a wire tie 46 secures sleeve 10 to fence post 12. To secure sleeve 10 to fence post 12, an end of wire tie 46 is thread through locking hole 44 drilled through first side 30, underneath a post clip 48 disposed on fence post 12, through a locking hole 44 drilled through second side 32, and then securely fastened to the other end of wire tie 46.

Figure 8:
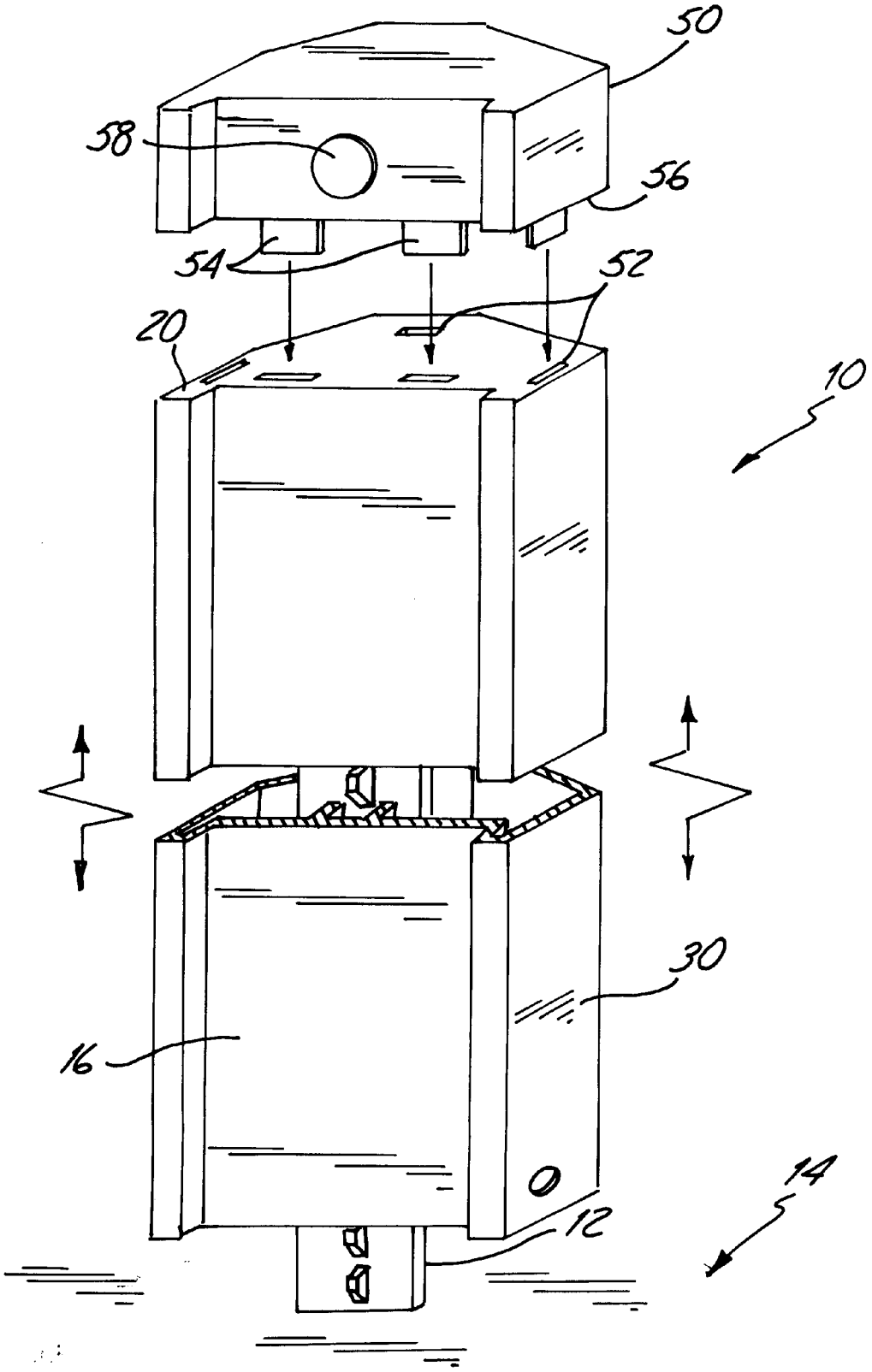
FIG. 8 is a front elevational view, with cross section, of the second embodiment engaging a scaleable add-on module having an electronic data storage device attached to the module.

FIG. 8 depicts a cross-sectional, front elevational view of the second embodiment of sleeve 10 with a scaleable add-on module 50 releasably engaging sleeve 10. At least one female fitting 52 is recessed in top 20 of sleeve 10. At least one male fitting 54 is attached to a bottom modular surface 56 of add-on module 50. Male fitting 54 projects downward from bottom modular surface 56. In operation, male fitting 52 is slidably engaged into female fitting 52. A data storage chip 58 is shown attached to scaleable module 50.

Figure 9:
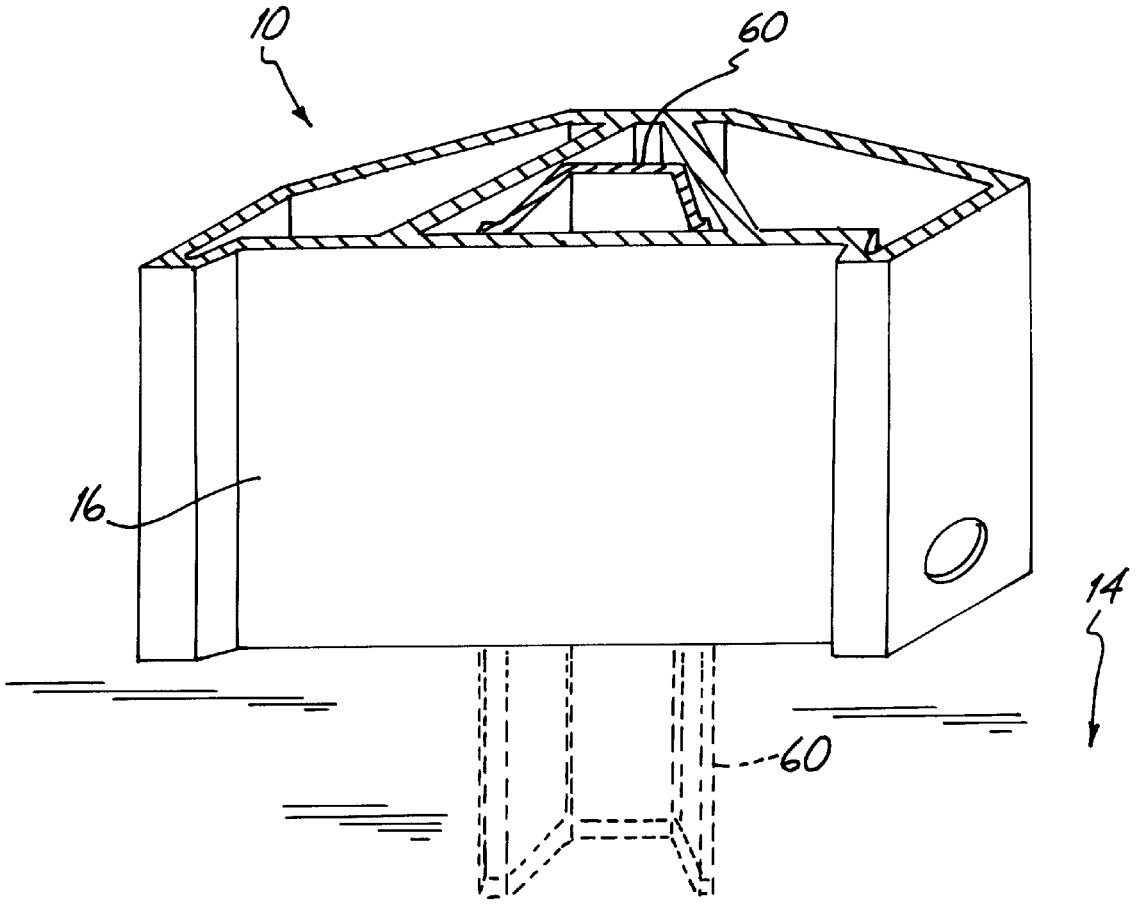
FIG. 9 is a front elevational view of the second embodiment slidingly engaging a metal sign post having a U-shaped cross section with the portion of the sign post located in the ground shown in phantom.

FIG. 9 depicts a front elevational view of the second embodiment of sleeve 10 slidingly engaging a sign post 60 having a U-shaped cross section.

Having illustrated and described the principles of the present invention in the preferred embodiments it will be apparent to those skilled in the art that the invention can be modified in arrangement and detail without departing from such principles. I claim all modifications coming within the scope and spirit of the following claims.

What is claimed:

1. A fence post sleeve for cooperating with a post having a cross sectional shape, the fence post sleeve comprising:

a tube of predetermined length having an interior surface and an exterior surface, the interior surface forming a channel longitudinally disposed within the tube, the channel having internal dimensions comprising a structure wherein a plurality of locations on the internal dimensions are substantially congruent with at least a portion of at least one external dimension of the post such that when the sleeve slidingly engages the post, rotation of the sleeve about a longitudinal axis of the post is precluded, the exterior surface having at least one flat surface for receiving labels for display, the flat surface extending longitudinally along the predetermined length of the sleeve wherein the sleeve has a top and a bottom, the top and the bottom having means for releasably interlocking with additional sleeves.

2. The sleeve of claim 1, wherein the exterior surface has means for receiving labels for display.

3. The sleeve of claim 1, wherein the internal dimensions of the channel form a webbing for receiving the post.

4. The sleeve of claim 1, further comprising at least one pair of teeth rigidly attached to the interior surface of the sleeve, the pair of teeth spaced apart an amount substantially congruent with at least a portion of the external dimensions of the post forming a receiving area between the pair of teeth for slidingly engaging the post, the pair of teeth precluding rotation of the sleeve about the longitudinal axis of the post.

5. The sleeve of claim 1, wherein the flat surface extends longitudinally the entire predetermined length of the sleeve.

6. The sleeve of claim 5, wherein the sleeve has a top having means for releasably engaging a module.

7. The sleeve of claim 1, wherein at least one female fitting is recessed in the top and at least one male fitting is attached projectingly to the bottom.

8. The sleeve of claim 1, wherein the sleeve has a means for securing the sleeve to the post.

9. The fence post sleeve of claim 1, wherein the tube has an open first end and an open second end.

10. The sleeve of claim 1, wherein an electronic data storage device for storing field location and crop identification validation information is secured to the sleeve.

11. A post sleeve for cooperating with a metal fence post having a T-shaped cross section, the sleeve comprising:

a sleeve of predetermined length, the sleeve having a top, a bottom, an interior, and an exterior surface, the interior forming a channel for releasably, slideably engaging the post;

a front pair of teeth;

a rear pair of teeth, each pair of teeth rigidly attached to the interior and opposing the other pair of teeth, each of the pair of teeth having internal dimensions between the teeth substantially congruent with at least a portion of the external dimensions of the metal fence post, the pairs of teeth precluding rotational movement of the sleeve about a longitudinal axis of the fence post when the pairs of teeth are engaging the fence post;

the exterior surface having a front surface, a back surface, a first side and a second side, the front surface having a flat configuration for receiving labels; and a pair of locking holes, one locking hole disposed on the first side adjacent the bottom and the other locking hole disposed on the second side adjacent the bottom, each of the locking holes providing a means for allowing a securing means for securing the sleeve to the fence post.

12. The sleeve of claim 11, wherein a female fitting is recessed in the top of the sleeve, the female fitting for releasably engaging a scaleable add-on module, the scaleable add-on module having a male fitting for releasably engaging the female fitting.

13. The sleeve of claim 12, wherein an electronic data storage device for storing field location and crop identification validation information is secured to the scaleable add-on module.

14. The sleeve of claim 11, wherein the front surface, back surface, first side and second side are of equal cross-sectional length.

15. The post sleeve of claim 11 wherein the top and bottom are each open.

16. A post sleeve for cooperating with a metal fence post having a T-shaped cross section, the sleeve comprising:

a sleeve of predetermined length, the sleeve having a top, a bottom, an interior, and an exterior surface, the interior forming a channel for releasably, slideably engaging the post;

the top and the bottom having means for releasably interlocking with additional sleeves;

a front pair of teeth;

a rear pair of teeth, each pair of teeth rigidly attached to the interior and opposing the other pair of teeth, each of the pair of teeth having internal dimensions between the teeth substantially congruent with at least a portion of the external dimensions of the metal fence post, the pairs of teeth precluding rotational movement of the sleeve about a longitudinal axis of the fence post when the pairs of teeth are engaging the fence post;

the exterior surface having a front surface, a back surface, a first side and a second side, the front surface having a flat configuration for receiving labels.

17. The post sleeve of claim 16 wherein the top and bottom are each open.

18. The sleeve of claim 16, wherein an electronic data storage device for storing field location and crop identification validation information is secured to the sleeve.

* * * * *